US007841420B2

(12) United States Patent
Sitabkhan

(10) Patent No.: US 7,841,420 B2
(45) Date of Patent: Nov. 30, 2010

(54) SELF-ACTIVATED FIRE EXTINGUISHER

(75) Inventor: Abdul Sitabkhan, Arcadia, CA (US)

(73) Assignee: X-Fire, LLC, Valencia, CA (US)

( * ) Notice: Subject to any disclaimer, the term of this patent is extended or adjusted under 35 U.S.C. 154(b) by 106 days.

(21) Appl. No.: 12/236,679

(22) Filed: Sep. 24, 2008

(65) Prior Publication Data

US 2009/0071664 A1 Mar. 19, 2009

Related U.S. Application Data

(63) Continuation-in-part of application No. 11/550,064, filed on Oct. 17, 2006, now abandoned.

(51) Int. Cl.
*A62C 37/12* (2006.01)
*A62C 3/00* (2006.01)

(52) U.S. Cl. ..... 169/57; 169/51; 169/65

(58) Field of Classification Search ..... 169/26, 169/37, 51, 54, 56, 57, 65, 68, 71, 72, 77
See application file for complete search history.

(56) References Cited

U.S. PATENT DOCUMENTS

| | | | |
|---|---|---|---|
| 1,616,974 | A | 2/1927 | Josephson |
| 2,786,537 | A | 3/1957 | Wainess |
| 2,800,187 | A | 7/1957 | Lehder |
| 2,871,952 | A | 2/1959 | Doak |
| 2,876,845 | A | 3/1959 | Boyce |
| 3,171,493 | A | 3/1965 | Barr |
| 3,587,747 | A | 6/1971 | Romero et al. |
| 3,800,878 | A | 4/1974 | Poitras |
| 3,827,502 | A | 8/1974 | Lockwood |
| 3,907,037 | A | 9/1975 | Linsalato et al. |
| 4,009,622 | A | 3/1977 | Hinderks |
| 5,503,231 | A | 4/1996 | Palmatier |
| 6,340,058 | B1 | 1/2002 | Dominick et al. |
| 6,648,077 | B2 | 11/2003 | Hoffman |
| 2004/0188102 | A1 | 9/2004 | Hall et al. |

FOREIGN PATENT DOCUMENTS

| | | |
|---|---|---|
| GB | 2230437 | 10/1990 |

*Primary Examiner*—Darren W Gorman
(74) *Attorney, Agent, or Firm*—Kelly Lowry & Kelley, LLP

(57) ABSTRACT

A self-activating fire extinguisher includes a pressure vessel having an outlet and containing a fire suppressant therein. A fusible material caps the outlet such that melting the fusible material allows escape of the fire suppressant from the pressure vessel. A deflector is associated with the pressure vessel for deflecting the fire suppressant escaping the pressure vessel onto a corresponding hazard.

22 Claims, 7 Drawing Sheets

SELF-ACTIVATED FIRE EXTINGUISHER

BACKGROUND OF THE INVENTION

The present invention relates to self-activated fire extinguishers. More specifically, the present invention relates to versatile fire extinguishers that self-activate via a heat or fire sensor and that distribute fire suppressant over a hazard with a deflector.

Fire extinguishers that automatically discharge in the presence of heat and/or fire are well known in the art. U.S. Pat. No. 3,171,493 to Barr discloses a fire protection device for a Christmas tree, wherein a valve opening is obstructed by one end of a pair of aligned rods held together by fusible metal which melts upon a corresponding rise in temperature. The valve opening is configured to eject a fire extinguishing foam upward so that it reflects off of a concave surface.

U.S. Pat. No. 2,876,845 to Boyce discloses a fire extinguisher for Christmas trees that operates automatically. The fire extinguisher includes a valve obstructed by a spring loaded gasket member held in place by a cup structure secured by a metal bead. The metal bead is constructed from a material designed to melt at a desired temperature. When the metal bead melts, the spring loaded gasket and cup structure are ejected thereby permitting the fire suppression agent to be ejected from the fire extinguisher.

U.S. Pat. No. 2,786,537 to Wainess is directed to a self-energizing fire extinguisher that has an elongate cylindrical valve member or stem which is retracted within the fire extinguisher and held in place by a low temperature melting solder. In the presence of heat the solder melts and the cylindrical valve member or stem is permitted to extend from the fire extinguisher thereby releasing the fire suppressant material.

U.S. Pat. No. 2,871,952 to Doak discloses a fire extinguisher having a closed valve member. An impact element or hammer having an elongated slot is positioned around the end of the valve member and held in place by a fusible link designed to rupture in the presence of heat. The impact element or hammer is spring loaded such that when the fusible link ruptures the spring draws the impact element or hammer against the valve member thereby breaking the stem of the valve member and releasing the fire suppressant material.

In each of these prior art devices the fire suppressant is aimed in the general direction in which the valve of the fire extinguisher itself is pointed and such fire extinguishers generally tend to have one valve. Some of the prior art devices provide reflective and/or deflective shields to increase the coverage area of the fire suppressant material. Another prior art device includes an oscillating valve member that slightly varies the direction of spray of the fire suppressant material. None of the prior art devices provide for easily recharging the fire extinguisher with new fire suppressant material after use. Such prior art devices typically need to be reconstructed in order to recharge the same.

There exists, therefore, a significant need in the art for a versatile self-activating fire extinguisher. Such a versatile self-activating fire extinguisher should include multiple interchangeable attachment mechanisms capable of fixing or otherwise attaching the fire extinguisher in a variety of fire prone areas, should contain pressurized fire suppressant material capable of being distributed through one or more multi-directional tubes refillable via a capillary inlet, should not dispense the fire retardant material directly onto the fire hazard, should include a deflector plate for evenly dispensing fire retardant material and should be suitable for application in a variety of fire hazard settings. The present invention fulfills these needs and provides further related advantages.

SUMMARY OF THE INVENTION

The self-activating fire extinguisher of the present invention includes a pressure vessel having an outlet and a fire suppressant material therein. A fusible material caps the outlet and prevents escape of the fire suppressant material from within the pressure vessel. Melting the fusible material enables the fire suppressant material to break through the cap and allows escape of the fire suppressant from the pressure vessel. Furthermore, the self-activating fire extinguisher includes a deflector associated with the pressure vessel for deflecting the fire suppressant escaping the pressure vessel. In a preferred embodiment, the fire suppressant includes a pressurized inert gas that may include Purple K Powder, a bicarbonate compound in water, Envirogel, or a halocarbon compound.

The deflector may be non-planar and is preferably shaped to dispense water over a fire hazard. The deflector may also include a heat shield and an adjacent insulation layer for protecting the pressure vessel from heat rising from a fire hazard. Moreover, the self-activating fire extinguisher may also include a mount associated with the pressure vessel. Preferably, the mount comprises a magnet, a coupler, a screw or a threaded base coupled to the pressure vessel, for attaching the pressure vessel to any one of a plurality of different locations. Accordingly, the pressure vessel should be rotatable about the mount.

In another alternative embodiment of the present invention, the self-activating fire extinguisher includes a tube having a proximate end in fluid contact with the fire suppressant and a distal end capped by the fusible material. At least a portion of the deflector should be positioned between the distal end of the tube and the pressure vessel. The outlet may further include an adapter for hermetically attaching the tube to the pressure vessel. In an alternative embodiment, the tube comprises multiple tubes that can direct fire suppressant material in multiple directions. These tubes may each be capped with a different fusible material that melts at different temperatures.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
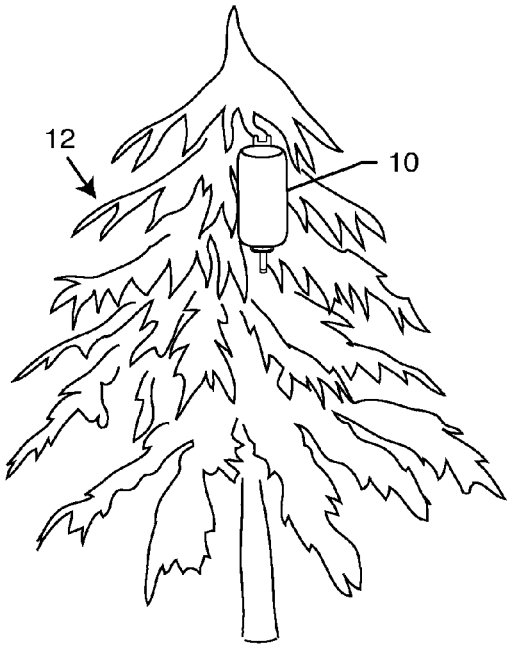
FIG. 1 is an environmental view of a fire extinguisher in accordance with the present invention hung on a Christmas tree.

As shown in the drawings for purposes of illustration, the present invention for a self-activated fire extinguisher is referred to generally by the reference number 10. In FIG. 1, the self-activating fire extinguisher 10 is illustrated as attached to a Christmas tree 12. The self-activating fire extinguisher 10 may be used in a Christmas tree 12 to prevent and extinguish fire hazards that start in and around a Christmas tree. Deploying the self-activating fire extinguisher 10 in the manner illustrated in FIG. 1 is merely a preferred embodiment. The many uses of the self-activating fire extinguisher 10 will be apparent from the detailed description below.

Figure 2:
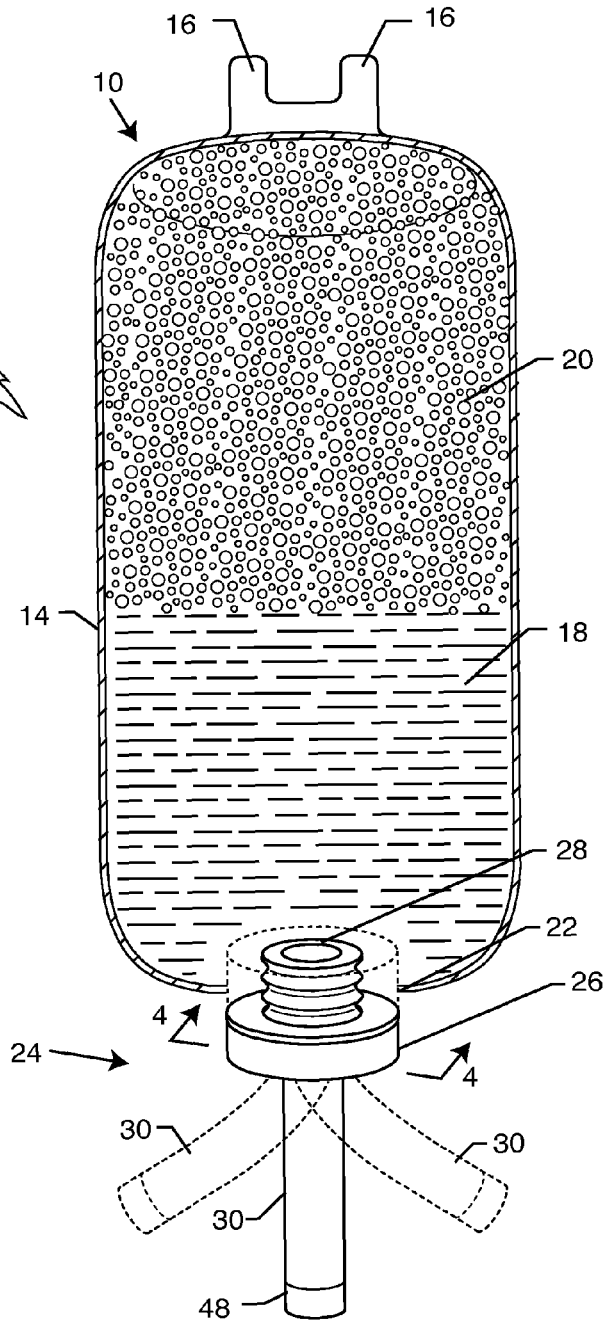
FIG. 2 is an elevated perspective view of the fire extinguisher of FIG. 1.

In FIG. 2, the self-activating fire extinguisher 10 is illustrated consisting of a plastic pressure vessel 14 that may be molded or configured in a variety of shapes and sizes. For example, the pressure vessel 14 may be spherical, cylindrical or rounded. The plastic composition of the pressure vessel 14 allows it to be painted or decorated with an external façade suitable for various usages such as a Christmas tree decoration. Of course, the pressure vessel 14 may be decorated for any suitable occasion such as holidays, birthdays or anniversaries. Moreover, the pressure vessel 14 includes a pair of mounting tabs 16 projecting therefrom. The mounting tabs 16 are preferably integrally molded from the plastic of the pressure vessel 14. The mounting tabs 16 enable the self-activating fire extinguisher 10 to be attached to any one of a plurality of objects, including the Christmas tree 12 in FIG. 1.

The pressure vessel 14 houses any one of a variety of fire suppressant agents. The fire suppressant agent 18 could include liquid, powder or a combination of both liquid and powder. Preferable fire suppressant agents usable with the present invention include Purple K Powder, any bicarbonate compound in a water solution, Envirogel or any halocarbon compound. The pressure vessel 14 may also contain a pressurized gas 20 to ensure that the fire suppressant agent 18 be ejected from the self-activating fire extinguisher 10, in accordance with the present invention. The pressurized gas 20 preferably comprises nitrogen. The interior of the pressure vessel 14 should be pressurized between approximately twenty to thirty pounds per square inch gauge (psig) to ensure efficient ejection of the fire suppressant agent 18. Additionally, other inert gases may be used in place of the nitrogen as the pressurized gas 20. Similarly, these inert gases should be used at pressures similar to nitrogen. The primary purpose of the pressurized gas 20 is to eject the fire suppressant agent 18 out from within the pressure vessel 14 in a timely manner.

Figure 3:
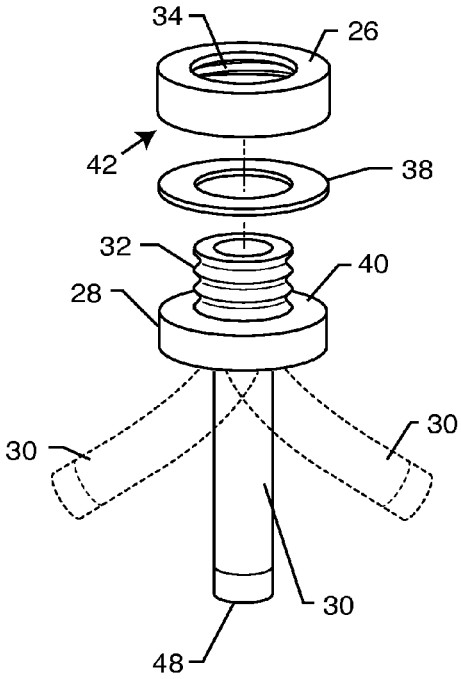
FIG. 3 is an exploded perspective view of a fitting that couples one or more tubes to the fire extinguisher body.

The pressure vessel 14 includes an outlet passageway 22 disposed in an end opposite the mounting tabs 16. The outlet passageway 22 provides access to the interior of the pressure vessel 14 and couples to a fitting 24 via a metal boss 26 embedded into the pressure vessel 14 around the outlet passageway 22. Embedding the metal boss 26 into the pressure vessel 14 around the outlet passageway 22 provides a water and airtight seal between the metal boss 26 and the outlet passageway 22. Accordingly, this prevents any of the fire suppressant agent 18 or the pressurized gas 20 from exiting the pressure vessel 14 between the metal boss 26 and the outlet passageway 22. The fitting 24 comprises an externally threaded coupler 28 having a tube 30 extending therefrom. The coupler 28 may include a plurality of tubes 30 as generally shown in FIGS. 2 and 3. The coupler 28 threadingly engages the internally threaded metal boss 26 as generally shown in FIG. 2 and regulates the ejection of the fire suppressant agent 18 from within the interior of the pressure vessel 14.

FIG. 3 illustrates an exploded view of the coupler 28 disengaged from the metal boss 26. As shown, the coupler 28 includes a set of external threads 32 that screwingly engage a set of internal threads 34 of the metal boss 26. The external threads 32 are disposed circumferentially around the exterior of an extension 36 of the coupler 28. An O-ring 38 is disposed around the exterior of the extension 36 to reside flush against a sealing surface 40 of the coupler 28. As the coupler 28 is threaded into the metal boss 26, the O-ring 38 becomes compressed between a bottom portion 42 of the metal boss 26 and the sealing surface 40 of the coupler 28. The O-ring 38 hermetically seals the fitting 24 to the metal boss 26 to prevent fire suppressant agent 18 or pressurized gas 20 from otherwise exiting the pressure vessel 14. The O-ring 38 may comprise a tin plated soft copper washer or other similar device capable of hermetically sealing the connection between the metal boss 26 and the coupler 28. Alternatively, the metal boss 26 and the coupler 28 do not necessarily need to include the threads 32, 34 pending that the metal boss 26 and the coupler 28 hermetically seal to one another. In a preferred embodiment, the coupler 28 can be removed, exchanged or replaced with other similar couplers having various configurations.

Figure 4:
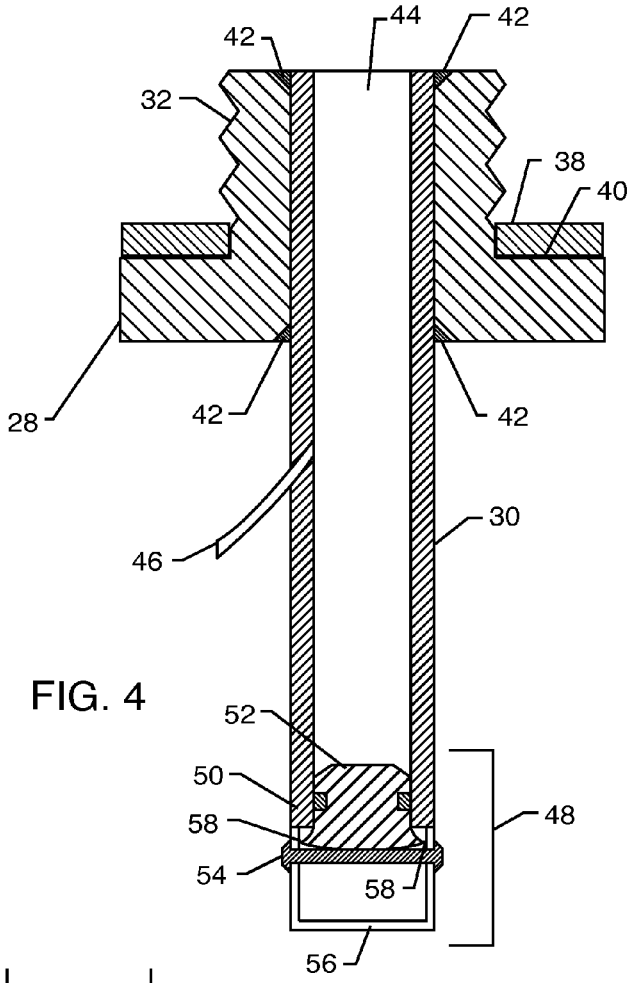
FIG. 4 is a cross-sectional view of the fitting and a corresponding tube, taken along the line 4-4 of FIG. 2.

FIG. 4 illustrates a tube 30 integral to the coupler 28. As previously illustrated in FIGS. 2 and 3, a plurality of the tubes 30 may be integrated with the coupler 28 in the manner described herein. As shown in FIG. 4, the tube 30 hermetically seals to the coupler 28 by a set of brazings 42. The brazings 42 are located both internally and externally relative to the pressure vessel 14. Moreover, the tube 30 includes a shaft 44 that extends through the interior of the coupler 28 (and corresponding metal boss 26 when attached to the pressure vessel 14) to provide access to the pressure vessel 14 through the outlet passageway 16. FIG. 4 further illustrates the O-ring 38 disposed on the sealing surface 40 of the coupler 28. Accordingly, the tube 30 (or multiple tubes) could differ in length, diameter or shape to provide different ejection patterns of the fire suppressant agent 18 in the pressure vessel 14. Moreover, a capillary inlet 46 may extend from a portion of the tube 30 and provide access to the shaft 44. The capillary inlet 46 is used to charge the pressure vessel 14 with the fire suppressant agent 18 and/or the pressurized gas 20. The capillary inlet 46 is preferably brazed to the tube 30 to create a hermetic seal. Once the pressure vessel 14 is charged with the fire suppressant agent 18 and the pressurized gas 20, the capillary inlet 46 is subsequently hermetically sealed by any method known in the art, such as by soldering. When charged, the self-activating fire extinguisher 10 may be used in accordance with the present invention.

The tube 30 further includes a valve mechanism 48. The valve mechanism 48 is spot welded, brazed or otherwise threaded onto an external end 50 of the tube 30. It is the valve mechanism 48 that allows the contents of the pressure vessel 14 to be discharged onto a nearby hazard. A sealing plug 52 is disposed within the shaft 44 at the external end 50 of the tube 30. The sealing plug 52 is used in conjunction with the valve mechanism 48 to seal the fire suppressant agent 18 and the pressurized gas 20 within the pressure vessel 14. The valve mechanism 48 includes a temperature sensor 54 adjacent to the sealing plug 52. The temperature sensor 54 retains the sealing plug 52 within the shaft 44 once the valve mechanism 48 is attached to the tube 30. The temperature sensor 54 comprises a fusible alloy that maintains the sealing plug 52 in the generally closed position as shown in FIG. 4. Here, the self-activating fire extinguisher 10 may be charged via the capillary inlet 46. The temperature sensor 54 is a specially formulated metal alloy that softens and melts at a precise temperature or within a given temperature range. Multiple tubes 30 may include multiple temperature sensors 54 that melt at various temperatures or within various temperature ranges. In a preferred embodiment, the temperature sensor 54 melts between 225° Fahrenheit (F) and 235° F. The temperature sensor 54 softens and/or melts when exposed to heat within the melting range of the fusible alloy.

Figure 5:
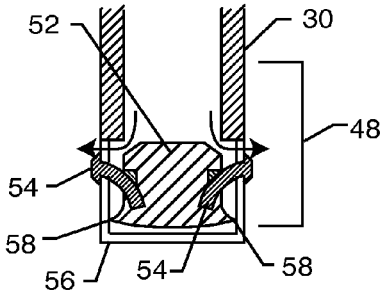
FIG. 5 is an enlarged cross-sectional view of the tube of FIG. 4, illustrating the conical plug broken through a fusible material.
Figure 6:
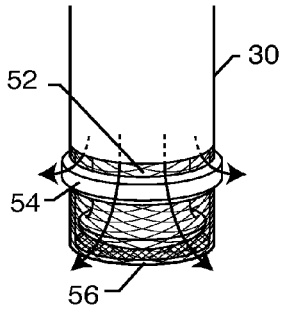
FIG. 6 is a perspective view of FIG. 5.

Melting the temperature sensor 54 allows the pressure inside the pressure vessel 14 to force open the valve mechanism 48 with the sealing plug 52. FIGS. 5 and 6 illustrate the sealing plug 52 broken through the temperature sensor 54. A permeable cage 56 retains the sealing plug 52 within the valve mechanism 48, thereby preventing the sealing plug 52 from being ejected out from within the shaft 44 and the valve mechanism 48. The fire suppressant agent 18 and the pressurized gas 20 are now capable of escaping out through the tube 30 and around the sealing plug 52 to exit the self-activating fire extinguisher 10. The pressure in the pressure vessel 14 forces the fire suppressant agent 18 out from the tube 30 and into a fire hazard zone. The tube 30 (or multiple tubes 30) may be flexible such that the external end 50 can be pointed toward specific areas that may be prone to a fire hazard. Additionally, the sealing plug 52 may be positioned and designed such as to include a pair of flanges 58 to discharge the fire suppressant agent 18 in a uniform 360° pattern. In another embodiment, each of the tubes 30 may include a temperature sensor 54, having a different melting point. Further, each tube 30 may include a sealing plug 52 having a unique shape capable of distributing the fire suppressant agent 18 in varying patterns.

Figure 7:
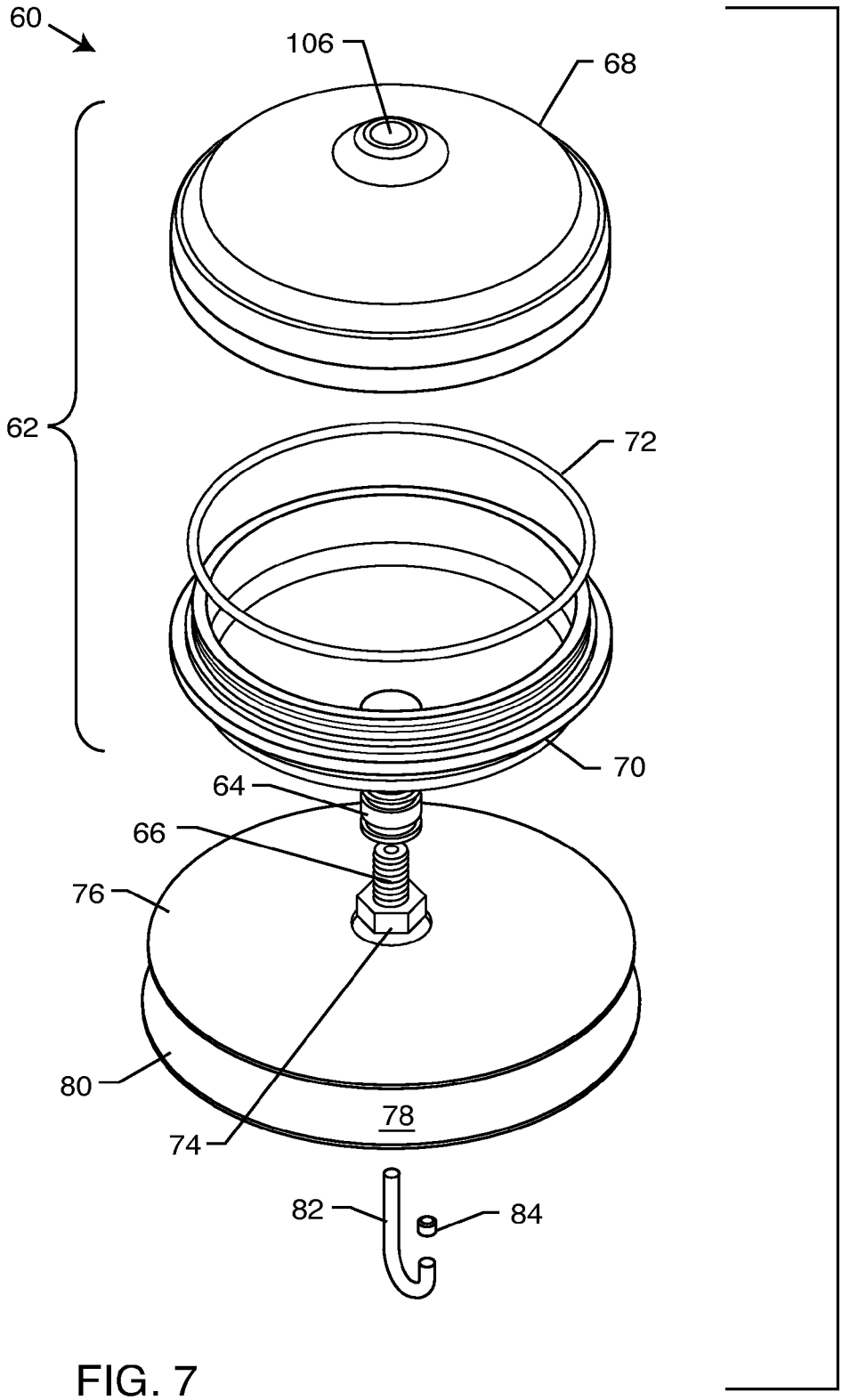
FIG. 7 is an exploded perspective view of a versatile fire extinguisher in accordance with the present invention.

FIGS. 7-13 illustrate an alternative embodiment of the self-activating fire extinguisher of the present invention. In these embodiments, the fire extinguisher is referred to as a versatile fire extinguisher 60. The versatile fire extinguisher 60 is also self-activating as described herein. In fact, the versatile fire extinguisher 60 includes all of the features of the self-activating fire extinguisher 10, including further related advantages. As shown in FIG. 7, the versatile fire extinguisher 60 generally includes a pressure vessel 62 having an attachment mechanism 64 capable of receiving a coupler 66. The pressure vessel 62 comprises a top section 68 that screwingly engages a bottom section 70. An O-ring 72 is disposed between the top section 68 and the bottom section 70 to hermetically seal the interior of the pressure vessel 62. The O-ring 72 is preferably manufactured from nitrile. Of course, the top section 68 and the bottom section 70 may attach to one another by any method known in the art (e.g. soldering) such that the aforementioned fire suppressant agent and corresponding pressurized gas may be retained therein. For example, the top section 68 may snap to the bottom section 70.

The attachment mechanism 64 is formed integrally to the bottom section 70 of the pressure vessel 62. Accordingly, any one of a plurality of couplers 66 may engage the attachment mechanism 64, depending on the specific application of the versatile fire extinguisher 60. In the embodiment shown in FIG. 7, the coupler 66 includes a fitting 74 for tightening the coupler 66 to the attachment mechanism 64. The fitting 74 is preferably a hex nut integrally formed to the coupler 66 that enables a user to screwingly tighten the coupler 66 to the attachment mechanism 64. An insulation layer 76 is disposed over a top portion 78 of a deflector 80, which is also integral to the coupler 66. In a preferred embodiment, the insulation layer 76 is made from an insulative rubber material and the deflector 80 is manufactured from aluminum or another highly temperature conductive material. The insulation layer 76 protects the body of the pressure vessel 62 from excess heat that may build in a fire prone area. The highly conductive deflector 80 is used to collect heat therein to activate the fire extinguisher 60, in accordance with the present invention. A tube 82 having a corresponding cap 84 extends from a lower portion of the coupler 66.

Figure 8:
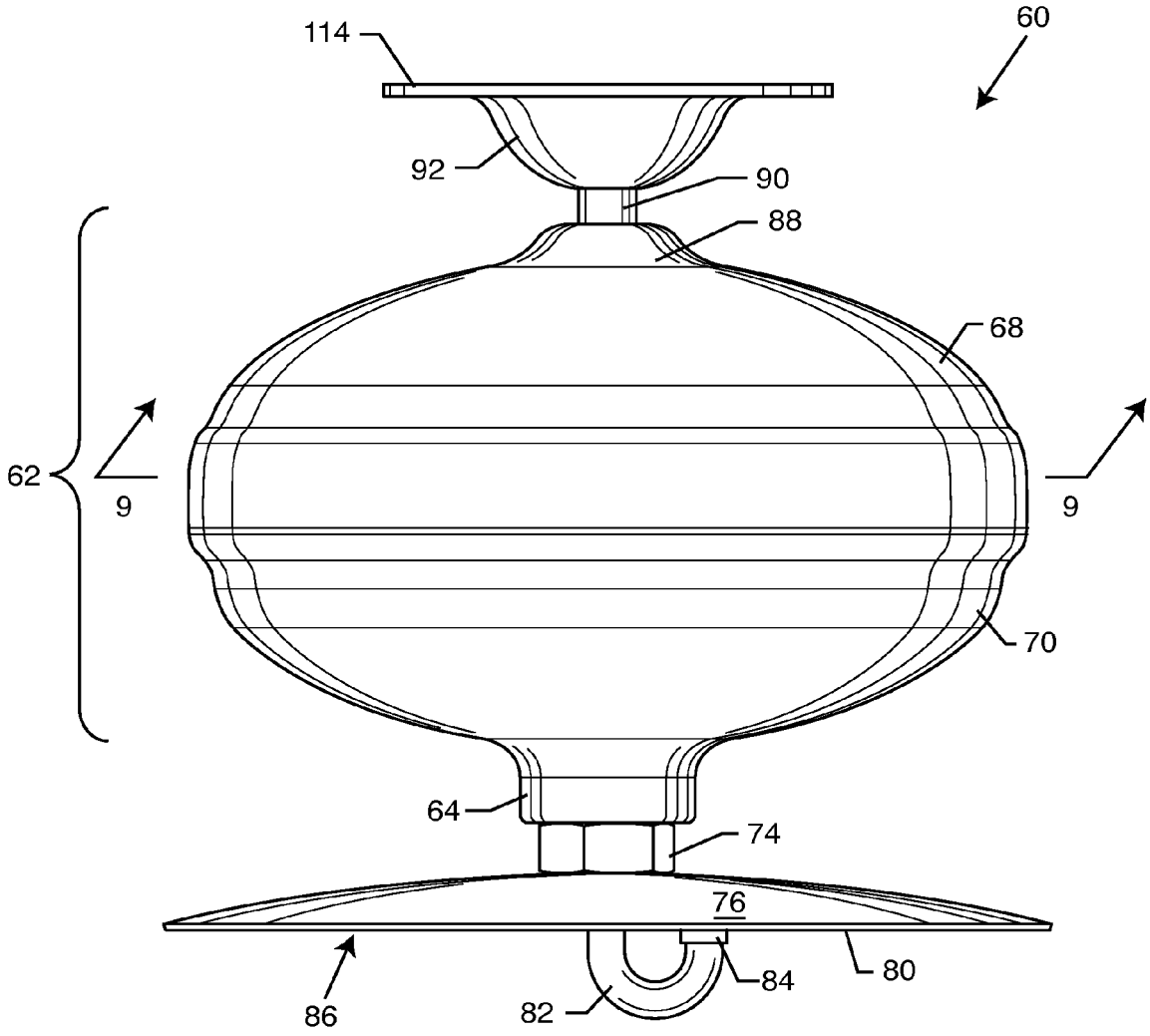
FIG. 8 is a front view of the versatile fire extinguisher of FIG. 7.

FIG. 8 illustrates a side view of the versatile fire extinguisher 60 in accordance with the present invention. As shown, the top section 68 is engaged with the bottom section 70 to form the pressure vessel 62. Likewise, the coupler 66 is screwingly engaged with the attachment mechanism 64 such that only the fitting 74 is illustrated. The deflector 80 includes the insulation layer 76 disposed on a top portion 78 (FIG. 10) thereof and is disposed adjacent to the fitting 74. The tube 82 extends from the pressure vessel 62 and is curved such that the cap 84 points up toward a bottom portion 86 of the deflector 80. Also shown in FIG. 8 is a mount 88 formed from the top section 68 and having a connector 90 extending therefrom for receiving a fastener 92. In this embodiment, the fastener 92 is used to secure the versatile fire extinguisher 60 to an area that may be subject to a fire hazard. In general, the mount 88 and the connector 90 are capable of coupling to any one of a number of different fasteners that can attach the versatile fire extinguisher 60 to a variety of surfaces. Hence, the versatile fire extinguisher 60 may be attached in places such as a motor vehicle, the kitchen or other places prone to a fire hazard.

Figure 9:
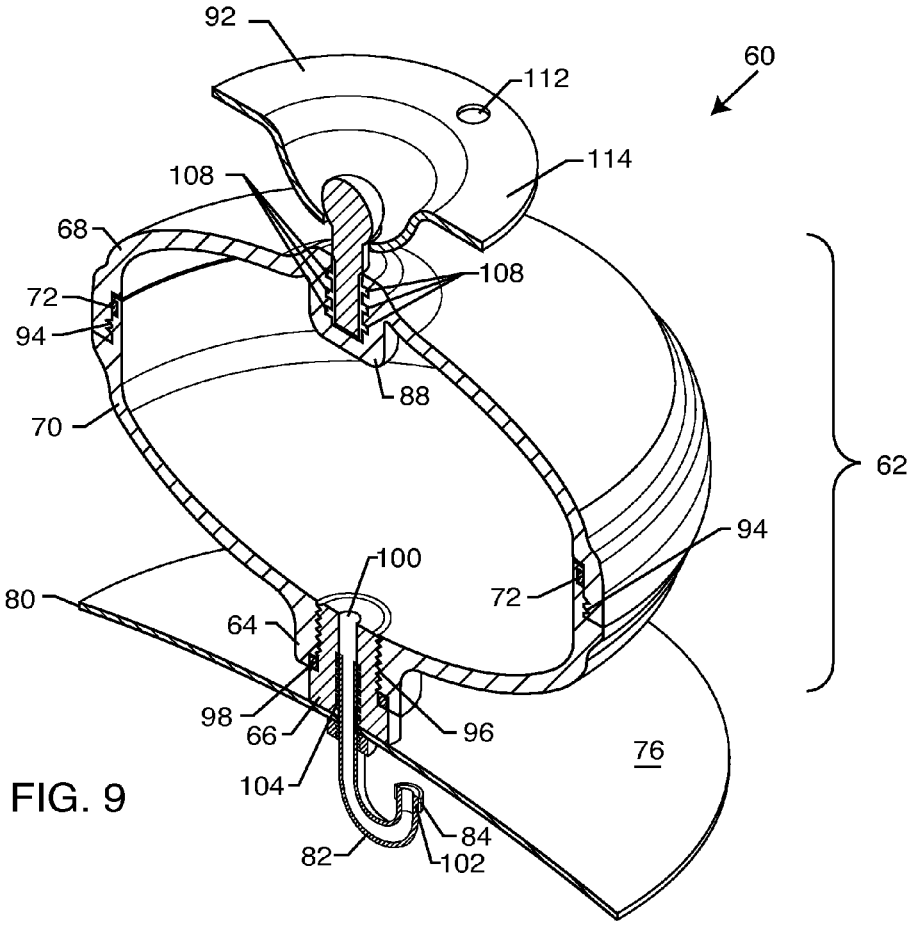
FIG. 9 is a cross-sectional perspective view of the versatile fire extinguisher, taken about the line 9-9 of FIG. 8.

FIG. 9 specifically illustrates the inner engagement of the various components of the versatile fire extinguisher 60. As shown, the top section 68 is screwingly engaged to the bottom section 70 by a pair of threads 94 disposed therebetween. The top section 68 and the bottom section 70 may otherwise be attached by a snap mechanism, an adhesive or any other mechanical or chemical attachment mechanism. The O-ring 72 hermetically seals the top section 68 and the bottom section 70 to prevent escape of the fire suppressant agent therein. FIG. 9 is an exemplary embodiment of the mount 88 formed in the top section 68 and the attachment mechanism 64 formed in the bottom section 70.

The attachment mechanism 64 is preferably formed out of the bottom section 70 as shown in FIG. 9. Alternatively, the attachment mechanism 64 may snap into or otherwise engage the bottom section 70. The coupler 66 includes a set of external threads 94 (FIG. 10) that screwingly engage a set of internal threads 96 generally illustrated in FIG. 9. An O-ring 98, similar to the O-ring 38, hermetically seals the connection between the attachment mechanism 64 and the coupler 66. The tube 82 includes a shaft 100 that extends through the interior of the coupler 66 and accesses the pressure vessel 62. An end 102 of the tube 82 includes the cap 84 for sealing the pressure vessel 62 from the external environment. The cap 84 may be similar to or the same as the previously described valve mechanism 48 illustrated in FIGS. 4-6. Alternatively, the cap 84 may simply comprise a fusible material that melts at a specific temperature. In this embodiment, the melted cap 84 allows the fire suppressant material within the pressure vessel 62 to be expelled out through the shaft 100. A series of brazings 104 hermetically seal the tube 82 to the coupler 66. In this embodiment, the tube 82 is curved such that the end 102 faces upward into the bottom portion 86 (FIG. 10) of the deflector 80. The deflector 80 includes an insulation layer 76 disposed on a top portion 78 (FIG. 7) to insulate the pressure vessel 62 from heat resulting from a nearby fire hazard. The deflector 80 is preferably slightly concave such that the end 102 of the tube 84 can be curved up underneath thereof as shown in FIG. 11. This enables the deflector 80 to accumulate heat therein to evenly and quickly melt the temperature sensor 54 (see FIGS. 4-6) in order to discharge fire suppressant agent from within the pressure vessel 62. The fire suppressant agent discharges from the tube 82 toward the bottom portion 86 of the deflector 80. This causes the main thrust of force of the fire suppressant material exiting the versatile fire extinguisher 60 to be absorbed by the bottom portion 86 of the deflector 80. This is particularly ideal when deploying the versatile fire extinguisher 60 in areas where directly spraying the fire hazard could result in further injury. For example, spraying a grease fire may cause hot grease to splatter and burn surrounding items. Instead, the versatile fire extinguisher 60 of the present invention does not forcefully project fire suppressant material upon the fire hazard area, but rather redirects the projected fire suppressant material off the deflector 80 such that fire hazard area receives light drops of evenly distributed fire suppressant material.

Figure 10:
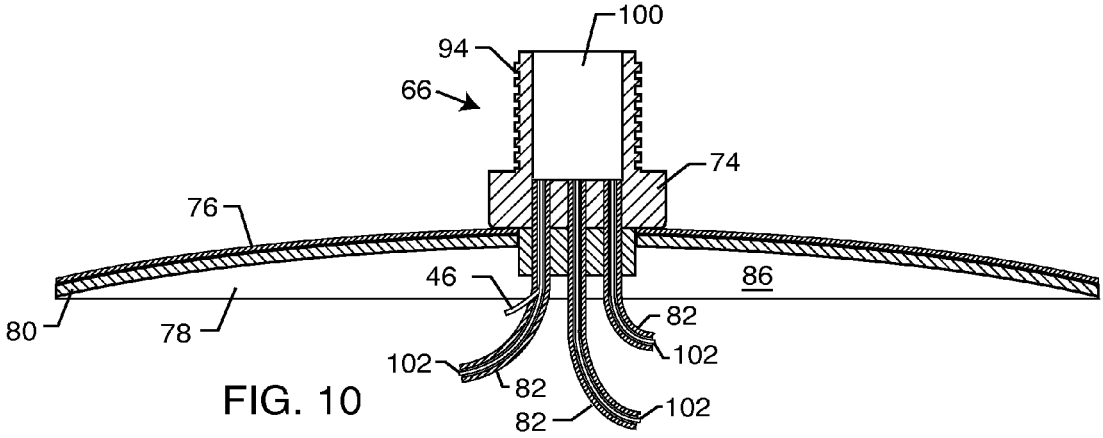
FIG. 10 is a cross-sectional view of a fitting that couples one or more tubes to the versatile fire extinguisher.
Figure 11:
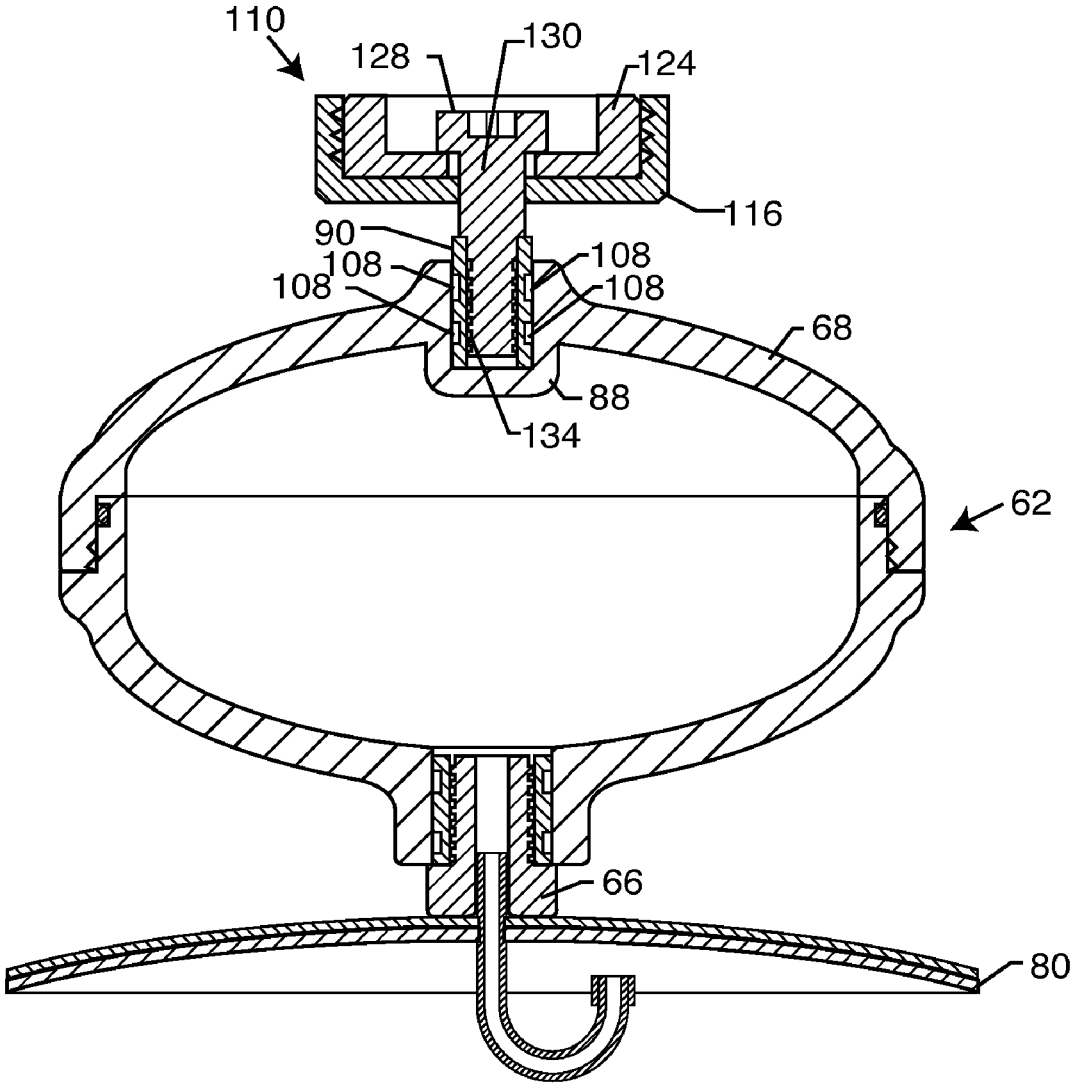
FIG. 11 is an alternative cross-sectional side view of the versatile fire extinguisher of FIG. 8, illustrating coupling of the magnet attachment mechanism of FIG. 12.

FIG. 10 illustrates an alternative embodiment in accordance with the present invention. Here, multiple tubes 82 extend from a common shaft 100 integral to the coupler 66. This coupler 66 is capable of projecting fire suppressant agent in more than one direction through the multiple tubes 82. The ends 102 of the tubes 82 may each point downwardly as generally shown in FIG. 10 or, more preferably, point upwardly as shown in FIG. 9. The deflector 80 includes an insulation layer 76 for collecting heat on a bottom portion 78 thereof for melting the fusible alloy material in the end 102 of the tubes 82. The insulation layer 76 prevents excess heat from traveling above the deflector 80 and into either the bottom section 70, the top section 68 or the fastening mechanism at the top of the versatile fire extinguisher 60. Moreover, the fitting 74 shown in FIG. 10 is preferably rigid and may be used in association with a wrench to tighten the coupler 66 to the attachment mechanism 64 (FIG. 9).

Figure 12:
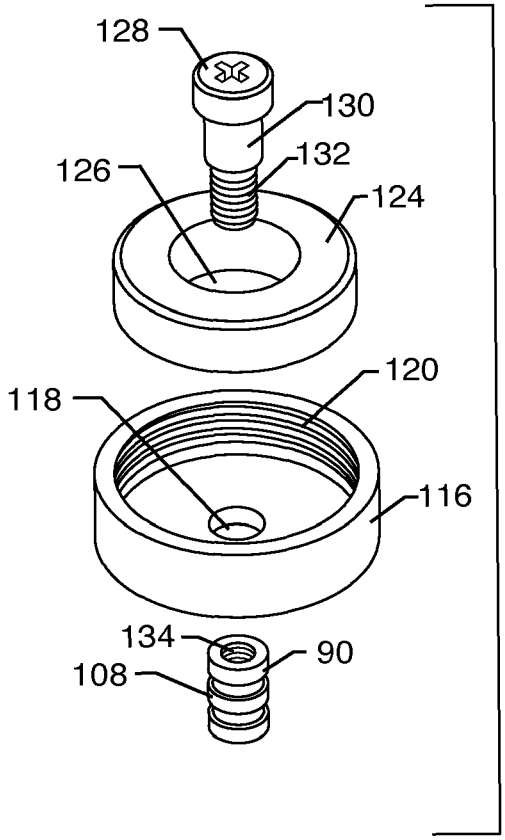
FIG. 12 is an explode perspective view of a magnet attachment mechanism for use with the versatile fire extinguisher.

Another aspect of the present invention is the mount 88 as generally shown in FIG. 8 and more specifically shown in FIGS. 9 and 11. The mount 88 is preferably formed integral to the top section 68 of the pressure vessel 62. The mount 88 includes a vertically extending cavity 106 (FIG. 7) that extends into the interior of the pressure vessel 62 as best shown in FIGS. 9 and 11. A plurality of ridges 108 line the interior of the cavity 106. FIG. 12 best illustrates the connector 90 that inserts into the cavity 106 and engages the ridges 108. FIG. 11 illustrates the connector 90 lodged within the mount 88 via the ridges 108. The connector 90 may also include a set of ridges 108 that extend beyond the cavity 106 in the top section 68. In this instance, any one of a plurality of fasteners, such as the fastener 92 illustrated in FIGS. 8 and 9 could attach thereto. Accordingly, the fastener 92 includes an aperture 112 within a horizontally extending base 114 capable of receiving a screw or other means for attaching the fastener 92 to another object. The fastener 92 can also rotate circumferentially around the connector 90 via the connecting ridges 108. This prevents any other portion of the versatile fire extinguisher 60 from inadvertently being unscrewed. Preferably, a wrench used in conjunction with the fitting 74 is required to unscrew the versatile fire extinguisher 60 from either the fastener 92 or other components of the versatile fire extinguisher 60 described herein.

In accordance with the present invention, FIG. 11 illustrates an alternative fastener 110 comprising a universal adapter 116. The universal adapter 116 is more specifically shown in FIG. 12 and includes an aperture 118 and a set of internal threads 120. In one embodiment of the present invention, the universal adapter 116 may engage the connector 90 by snuggly fitting the aperture 118 to one of the ridges 108 of the connector 90. In another alternative embodiment, a magnet 124 having a planar base 126 engageable with a head 128 of a screw 130 is attachable to the universal adapter 116 via the connector 90. Here, the screw 130, via a set of external threads 132, screwingly engages the internal threads 134 in the connector 90. FIG. 11 illustrates the screw 130 threaded into the connector 90 to engage the magnet 124 to the universal adapter 116. The magnet 124 may thereafter be attached to metal or another magnetized object to suspend the versatile fire extinguisher 60 therefrom. Accordingly, this enhances the versatility of the fire extinguisher 60 in placement and location. The magnet 124 can be used to locate the versatile fire extinguisher 60 underneath an exhaust hood or over a stove in a kitchen, for example. The magnet is non-destructible to the metal hood and the versatile fire extinguisher 60 is not otherwise visible when placed within the hood. The magnet 124 may be angled and capable of attaching to the side of such a hood.

Figure 13:
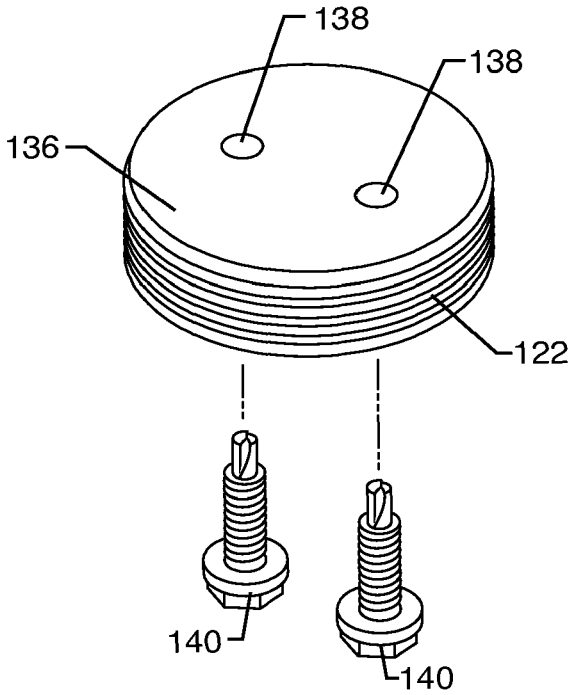
FIG. 13 is an exploded perspective view of a screw attachment mechanism for use with the versatile fire extinguisher of the present invention.

Moreover, the universal adapter 116 is capable of receiving a mechanical fastener 136 by screwing together the internal threads 120 to a set of external threads 122. FIG. 13 illustrates the mechanical fastener 136 that screwingly engages the universal adapter 116 with the external threads 122. The mechanical fastener 136 has a pair of apertures 138 for receiving a pair of lock screws 140 therein. The lock screws 140 extend through the width of the mechanical fastener 136 and screw into a desired object to which the versatile fire extinguisher 60 is to be mounted. The apertures 138 are non-threaded so the lock screws 140 do not actually engage the mechanical fastener 136. In this embodiment, two lock screws 140 are used in conjunction with the mechanical fastener 136 to prevent rotation thereof. The versatile fire extinguisher 60 is screwingly installed thereto via the internal threads 120 of the universal adapter 116.

Moreover, the deflector 80 can mount to the coupler 66 such that it may freely rotate relative thereto in the event someone grabs the deflector 80 attempting to turn or rotate the versatile fire extinguisher 60. Again, this feature prevents undesired unscrewing of any of the aforementioned components of the versatile fire extinguisher 60.

Although several different embodiments have been described in detail for purposes of illustration, various modifications may be made to each without departing from the spirit and scope of the invention. Accordingly, the invention is not to be limited, except as by the appended claims.

The invention claimed is:

1. A self-activating fire extinguisher, comprising:

a pressure vessel containing a fire suppressant and including an outlet;

a fusible material capping the outlet, wherein melting the fusible material allows escape of the fire suppressant from the pressure vessel; and a deflector associated with the pressure vessel, for reflecting the fire suppressant escaping the pressure vessel, wherein the deflector includes a heat shield and an adjacent insulation layer.

2. The fire extinguisher of claim 1, wherein the outlet includes a tube having a proximate end in fluid contact with the fire suppressant, and a distal end capped by the fusible material.

3. The fire extinguisher of claim 2, wherein the tube comprises multiple tubes.

4. The fire extinguisher of claim 2, wherein at least a portion of the deflector is positioned between the pressure vessel and the distal end of the tube.

5. The fire extinguisher of claim 2, wherein the outlet includes an adapter for hermetically attaching the tube to the pressure vessel.

6. The fire extinguisher of claim 1, wherein the deflector comprises a non-planar shape.

7. The fire extinguisher of claim 1, wherein the fire suppressant includes a pressurized inert gas.

8. The fire extinguisher of claim 1, wherein the fire suppressant comprises Purple K Powder, a bicarbonate compound in water, or a halocarbon compound.

9. The fire extinguisher of claim 1, including a mount associated with the pressure vessel.

10. The fire extinguisher of claim 9, wherein the mount comprises a magnet, a coupler, a screw or a threaded base.

11. The fire extinguisher of claim 10, wherein the pressure vessel is rotatable about the mount.

12. A self-activating fire extinguisher, comprising:

a pressure vessel containing a fire suppressant and including an outlet, the outlet having a tube with a proximate end in fluid contact with the fire suppressant;

a fusible material capping a distal end of the tube, wherein melting the fusible material allows escape of the fire suppressant from the pressure vessel;

a mount associated with the pressure vessel; and a deflector associated with the pressure vessel, for reflecting the fire suppressant escaping the pressure vessel, wherein at least a portion of the deflector is positioned between the pressure vessel and the distal end of the tube, wherein the deflector includes a heat shield and an adjacent insulation layer.

13. The fire extinguisher of claim 12, wherein the deflector comprises a non-planar shape.

14. The fire extinguisher of claim 12, wherein the tube comprises multiple tubes.

15. The fire extinguisher of claim 12, wherein the outlet includes an adapter for hermetically attaching the tube to the pressure vessel.

16. The fire extinguisher of claim 12, wherein the fire suppressant comprises Purple K Powder, a bicarbonate compound in water, or a halocarbon compound and includes a pressurized inert gas.

17. The fire extinguisher of claim 12, wherein the pressure vessel is rotatable about the mount which comprises a magnet, a coupler, a screw or a threaded base.

18. A self-activating fire extinguisher, comprising:

a pressure vessel including an outlet and containing a pressurized inert gas and a fire suppressant comprising Purple K Powder, a bicarbonate compound in water, or a halocarbon compound, wherein the outlet includes an adapter for hermetically attaching a proximate end of a tube to the pressure vessel;

a fusible material capping the tube, wherein melting the fusible material allows escape of the fire suppressant from the pressure vessel;

a mount associated with the pressure vessel; and a deflector associated with the pressure vessel, for reflecting the fire suppressant escaping the pressure vessel, wherein the deflector includes a heat shield and an adjacent insulation layer.

19. The fire extinguisher of claim 18, wherein the tube comprises multiple tubes.

20. The fire extinguisher of claim 18, wherein at least a portion of the deflector is positioned between the pressure vessel and a distal end of the tube.

21. The fire extinguisher of claim 18, wherein the deflector comprises a non-planar shape.

22. The fire extinguisher of claim 18, wherein the pressure vessel is rotatable about the mount which comprises a magnet, a coupler, a screw or a threaded base.

* * * * *